US005453353A

United States Patent [19]

Arai et al.

[11] Patent Number: 5,453,353

[45] Date of Patent: Sep. 26, 1995

[54] LIGHT-SENSITIVE SILVER HALIDE PHOTOGRAPHIC MATERIAL

[75] Inventors: Takeo Arai; Nobuaki Kagawa, both of Tokyo, Japan

[73] Assignee: Konica Corporation, Tokyo, Japan

[21] Appl. No.: 225,393

[22] Filed: Apr. 8, 1994

[30] Foreign Application Priority Data

Apr. 13, 1993 [JP] Japan ..... 5-086246

[51] Int. Cl.[6] ..... G03C 1/29

[52] U.S. Cl. ..... 430/573; 430/574; 430/576; 430/577; 430/578; 430/583; 430/585; 430/591; 430/592

[58] Field of Search ..... 430/572, 573, 430/574, 576, 577, 578, 591, 592, 593, 583, 585

[56] References Cited

U.S. PATENT DOCUMENTS

| | | | |
|---|---|---|---|
| 5,112,731 | 5/1992 | Miyasaka | 430/592 |
| 5,116,722 | 5/1992 | Callant et al. | 430/578 |

FOREIGN PATENT DOCUMENTS

| | | | |
|---|---|---|---|
| 0540295 | 5/1993 | European Pat. Off. | 430/593 |
| 1124845 | 5/1989 | Japan | 430/592 |
| 100347 | 4/1993 | Japan | 430/593 |
| 0677409 | 5/1991 | Switzerland | 430/591 |
| 212749 | 12/1966 | U.S.S.R. | 430/578 |

*Primary Examiner*—Lee C. Wright

*Attorney, Agent, or Firm*—Jordan B. Bierman; Bierman and Muserlian

[57] ABSTRACT

Disclosed is a silver halide photographic light-sensitive material comprising a support and thereon at least one light-sensitive silver halide emulsion layer, wherein said silver halide emulsion layer contains a compound represented by Formula S-I and a compound represented by Formulas S-II or S-III:

Formula S-I;

Formula S-II;

Formula S-III;

8 Claims, No Drawings

LIGHT-SENSITIVE SILVER HALIDE PHOTOGRAPHIC MATERIAL

FIELD OF THE INVENTION

This invention relates to a light-sensitive silver halide photographic material, and more particularly to a light-sensitive silver halide photographic material having a higher spectral sensitivity in the red-light wavelength region and improved in residual color stain proofness.

BACKGROUND OF THE INVENTION

Means of expanding the spectral wavelength region of silver halide photographic emulsions (hereinafter "silver halide emulsions" or simply "emulsions") and improving their sensitivity are known as spectral sensitization techniques. Spectral sensitizing dyes used for such purposes are known to include a large number of compounds such as cyanine dyes and merocyanine dyes.

These spectral sensitizing dyes must be able not only to expand the spectral wavelength region of silver halide emulsions but also to satisfy the following various requirements.

1) They have appropriate spectral sensitizing regions.
2) They have a high spectral sensitization efficiency.
3) They cause no fog and have no ill influence on the characteristic curve, e.g., changes of gamma.
4) They cause no changes in photographic performance such as fog when light-sensitive materials containing sensitizing dyes are aged, in particular, when stored in an environment of high temperature and high humidity.
5) They cause no color cross-over because of diffusion of a sensitizing dye to a layer having a different spectral wavelength region.
6) They cause no dye-stain after developing, fixing and washing.

However, none of spectral sensitizing dyes hitherto disclosed have attained the level high enough to well satisfy all of these requirements. In particular, as developing time has been made shorter and washless processing or processing solution recycling has become usable, dyes have become likely to remain in processing solutions.

As a result, color stain has come to appear in light-sensitive materials having been processed (hereinafter "residual color stain"), causing the problem of a great fall in values of commercial products. In other words, how better prevent the residual color stain in spectral sensitizing dyes has come into question as an important technical problem.

As spectral sensitizing dyes capable of achieving spectral sensitization in the red-light wavelength region, those which are known to be effective are exemplified by complex cyanine dyes or complex merocyanine dyes disclosed in Belgian Patent No. 541,245, U.S. Pat. No. 2,493,747, No. 2,493,748, No. 2,743,272 and No. 3,335,010, French Patent No. 2,113,248, German Patents No. 1,024,800, No. 2,153,570 and No. 2,300,321 and Japanese Patent Publication Open to Public Inspection (hereinafter referred to as Japanese Patent O.P.I. Publication) No. 171135/1991; cyanine dyes disclosed in Japanese Patent O.P.I. Publications No. 11121/1974, No. 33622/1976, No. 115821/1976, No. 115822/1976, No. 72937/1983, No. 203446/1986, No. 256054/1990 and No. 15042/1991; and merocyanine dyes disclosed in U.S. Pat. No. 2,493,747, No. 2,493,748 and No. 2,519,001 and Japanese Patent O.P.I. Publications No. 106422/1976 and No. 214030/1984.

Some of these dyes have been made less ascribable to residual color stain by introducing a water-soluble group into the molecule, but can not be well effective for its prevention or have the problems that spectral sensitivity becomes lower and sensitivity variations tend to occur as coating solutions are aged or stand with time. Thus, they still can not be satisfactory.

Dyes disclosed in recent years in European Patents No. 363,104 and No. 363,107 are seen to have been improved in residual color stain proofness, but have the problem that photographic performance may vary and deteriorate when light-sensitive materials having been subjected to spectral sensitization are left to stand for their storage.

Hithertofore, it is well known to carry out spectral sensitization using two or more kinds of spectral sensitizing dyes in combination for the purpose of improving spectral sensitivity in the red-light wavelength region as in the case of the present invention. For example, they are typified by specific thia- or selenacarbocyanine dyes. Such spectral sensitization, however, can not better prevent the residual color stain.

Japanese Patent O.P.I. Publications No. 18726/1979, No. 135461/1984, No. 246054/1987, etc. disclose a technique in which a supersensitizer is used together to increase spectral sensitivity so that a load of residual color stain can be decreased. This, however, is still at an unsatisfactory level, and it has been sought to make a further improvement.

SUMMARY OF THE INVENTION

Accordingly, an object of the present invention is to proved a light-sensitive silver halide photographic material having a higher spectral sensitivity in the red-light wavelength region and improved in residual color stain proofness.

The problems as discussed above has been solved by the invention described below. That is, the problems can be solved by a light-sensitive silver halide photographic material comprising a combination of a compound represented by the following Formula S-I and at least one of a compound represented by the following Formula S-II and a compound represented by the following Formula S-III.

Formula S-I

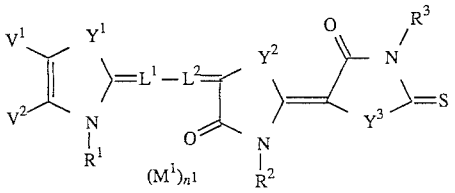

Formula S-II

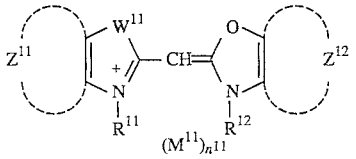

Formula S-III

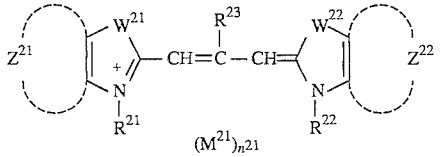

In the formulas, $Y^1$, $Y^2$ and $Y^3$ each represent an —N(R)— group, an oxygen atom, a sulfur atom or a selenium atom; $W^{11}$ represents an oxygen atom, a sulfur atom or a selenium atom; and $W^{21}$ and $W^{22}$ each represent a sulfur atom or a selenium atom.

$R^1$ represents an aliphatic group having 10 or less carbon atoms having a water-solubilizing group as a substituent; and R, $R^2$ and $R^3$ each represent an aliphatic group, an aryl group or a heterocyclic group, and at least two of R, $R^2$ and $R^3$ have a water-solubilizing group. $R^{11}$ and $R^{12}$ each represent an aliphatic group having 10 or less carbon atoms, at least one of which has a water-solubilizing group as a substituent. $R^{21}$ and $R^{22}$ each represent an aliphatic group having 10 or less carbon atoms, and $R^{23}$ represents a hydrogen atom, an aliphatic group, an aryl group or a heterocyclic group.

$V^1$ and $V^2$ each represent a hydrogen atom, an alkyl group, an alkoxyl group or an aryl group, and $V^1$ and $V^2$ may combine to form a condensed ring together with the azole ring; and $L^1$ and $L^2$ each independently represent a substituted or unsubstituted methine carbon. $Z^{11}$ and $Z^{12}$ each represent a non-metal atomic group necessary to form a condensed cyclichydrocarbon ring, and in the condensed cyclichydrocarbon ring, a condensed benzene ring or a condensed naphthalene ring is preferably used, $Z^{21}$ and $Z^{22}$ each represent a non-metal atomic group necessary to form a condensed benzene ring or a condensed naphthalene ring, and these condensed rings may have any substituent at any position thereon.

At least one group of $Z^{21}$ and $Z^{22}$ forms a condensed naphthalene ring.

$M^1$, $M^{11}$ and $M^{21}$ each represent an ion necessary to neutralize the total charge of molecule, and $n^1$, $n^{11}$ and $n^{21}$ each represent a number necessary to neutralize the charge of molecule.

Formulas S-II and S-III are each described as a canonical structure. Although the canonical structure is one of several resonance structures respectively, and a cation seems to be localized on a nitrogen atom of a molecule, the cation is actually unlocalized in the molecule.

DETAILED DESCRIPTION OF THE INVENTION

The present invention will be described below in detail.

In the compounds represented by Formulas S-I and S-II, the water-solubilizing group substituted on R, $R^1$, $R^2$, $R^3$, $R^{11}$ and $R^{12}$ each may include acid groups as exemplified by a sulfo group, a carboxyl group, a phosphono group, a sulfato group and a sulfino group.

The aliphatic group represented by R, $R^1$, $R^2$, $R^3$, $R^{11}$, $R^{12}$, $R^{21}$, $R^{22}$ and $R^{23}$ each may include, for example, branched or straight-chain alkyl groups having 1 to 10 carbon atoms as exemplified by groups such as methyl, ethyl, n-propyl, n-pentyl and isobutyl, alkenyl groups having 3 to 10 carbon atoms as exemplified by groups such as 3-butenyl and 2-propenyl, and aralkyl groups having 7 to 10 carbon atoms as exemplified by groups such as benzyl and phenetyl.

The aryl group represented by R, $R^2$ and $R^3$ each may include, for example, a phenyl group, and the heterocyclic group may include, for example, a pyridyl group (2-, 4-), a furyl group (2-), a thienyl group (2-), a sulforanyl group, a tetrahydrofuryl group and a piperidinyl group.

The aryl group represented by $R^{23}$ may include, for example, a phenyl group, and the heterocyclic group may include, for example, groups such as a furyl group (2-), a thienyl group (2-), 1-phenyl-5-hydroxy-3-methyl-4-pyrazolyl, 4-hydroxy-2-methyl-1,1-dioxo-4-thiazolyl, 1,2,3,4-tetrahydro-1,3-bis(2-ethoxyethyl)-6-hydroxy-2,4-dioxo-5-pyrimidinyl and 1,2,3,4-tetrahydro-l,3-bis(2-menthoxyethyl)-6-hydroxy-4-oxo-2-thioxo-5-pyrimidinyl.

The groups R, $R^1$, $R^2$, $R^3$, $R^{11}$, $R^{12}$, $R^{21}$ and $R^{22}$ may be substituted with a substituent such as a halogen atom as exemplified by a fluorine atom, a chlorine atom or a bromine atom, an alkoxyl group as exemplified by a methoxy group or an ethoxy group, a cyano group, a carbamoyl group as exemplified by a carbamoyl group, an N-methylcarbamoyl group or an N,N-tetra-methylenecarbamoyl group, a sulfamoyl group as exemplified by a sulfamoyl group or an N,N-3-oxapentamethyleneaminosulfonyl group, a methanesulfonyl group, an alkoxylcarbonyl group as exemplified by an ethoxycarbonyl group or a butoxycarbonyl group, an aryl group as exemplified by a phenyl group or a carboxyphenyl group, or an acyl group as exemplified by an acetyl group or a benzoyl group.

The aliphatic group having a water-solubilizing group may specifically include groups such as carboxymethyl, sulfoethyl, sulfopropyl, sulfopropyl, sulfopentyl, 3-sulfobutyl, 6-sulfo-3-oxahexyl, ω-sylfopropoxycarbonylmethyl, ω-sylfopropylaminocarbonyl-methyl, 3-sulfinobutyl, 3-phosphonopropyl, 4-sulfo-3-butenyl, 2-carboxy-2-propenyl, o-sulfobenzyl, p-sulfophenetyl and p-caroxybenzyl. The aryl group having a water-solubilizing group may specifically include groups such as a p-sulfophenyl group and a p-carboxyphenyl group. The heterocyclic group substituted with a water-solubilizing group may specifically include groups such as 4-sulfothienyl group and a 5-carboxypyridyl group.

The alkyl group represented by $V^1$ and $V^2$ each may include straight-chain or branched groups as exemplified by groups such as methyl, ethyl, iso-propyl, t-butyl, iso-butyl, t-pentyl and hexyl. The alkoxyl group represent by $V^1$ and $V^2$ each may include, for example, groups such as methoxy, ethoxy and propoxy.

The aryl group represented by $V^1$ and $V^2$ each may have a substitutent at any position, which may include, for example, groups such as phenyl, p-tolyl, p-hydroxyphenyl and p-methoxyphenyl. The condensed group which $V^1$ and $V^2$ combine to form together with the azole ring may include, for example, condensed rings such as benzoxazole, 4,5,6,7-tetrahydrobenzoxazole, naphthalene[1,2-d]oxazole, naphthalene[2,3-d]oxazole, benzothiazole, 4,5,6,7-tetrahydrobenzothiazole, naphthalene[1,2-d]thiazole, naphthalene [2,3-d]thiazole, benzoselenazole and naphthalene[1,2-d]selenazole.

The azole ring formed by the condensed cyclic hydro carbon ring, represented by $Z^{11}$ and $Z^{12}$ may specifically include condensed rings as exemplified by 4,5-trimethyleneoxazole, 3,4,5,6,7-tetrahydrobenzoxazole, benzoxazole, naphthalene[1,2-d]oxazole, naphthalene[2,3d]oxazole, 4,5-trimethylenethiazole, 4,5,6,7-tetrahydrobenzothiazole, benzothiazole, naphthalene[1,2d]thiazole, naphthalene[2,3-d] thiazole, benzoselenazole and naphthalene[1,2-d] selenazole. The azole ring formed by the condensed benzene ring or condensed naphthalene ring represented by $Z^{21}$ and $Z^{22}$ may specifically include condensed rings as exemplified by benzothiazole, naphthalene[1,2d]thiazole, naphthalene[2, 3-d]thiazole, benzoselenazole and naphthalene[1,2-d]selenazole.

The substituents represented by $V^1$ and $V^2$ and the condensed ring formed by them and the condensed ring represented by $Z^{11}$ and $Z^{12}$, as well as the condensed benzene ring and condensed naphthalene ring represented by $Z^{11}$ and $Z^{12}$ or $Z^{21}$ and $Z^{22}$ may each have a substituent at any position, which may include, for example, any of halogen atoms such as a fluorine atom, a chlorine atom, a bromine atom and an iodine atom, a trifluoromethyl group, alkoxyl groups as exemplified by unsubstituted alkoxyl groups such as methoxy, ethoxy and butoxy and substituted alkoxyl groups such as 2-methoxyethoxy and benzyloxy, a hydroxyl group, a cyano group, aryloxyl groups as exemplified by substituted or unsubstituted groups such as phenoxy and tolyloxy, aryl groups as exemplified by substituted or unsubstituted groups such as phenyl and p-chlorophenyl, a styryl group, heterocyclic groups as exemplified by groups such as furyl and thienyl, carbamoyl groups as exemplified by groups such as a carbamoyl group and an N-ethylcarbamoyl group, sulfamoyl groups as exemplified by groups such as sulfamoyl and N-N-dimethylsulfamoyl, acylamino groups as exemplified by groups such as acetylamino, propionylamino and benzoylamino, acyl groups as exemplified by groups such as acetyl and benzoyl, alkoxycarbonyl groups as exemplified by groups such as ethoxycarbonyl, sulfonamido groups as exemplified by groups such as methanesulfonamido and benzenesulfonamido, sulfonyl groups as exemplified by groups such as methanesulfonyl and p-toluenesulfonyl, and carboxyl groups.

The group substituted on the methine carbon represented by $L^1$ and $L^2$ each may include, for example, lower alkyl groups as exemplified by groups such as methyl and ethyl, phenyl groups as exemplified by groups such as phenyl and carboxyphenyl, and alkoxyl groups as exemplified by groups such as methoxy and ethoxy. $M^1$, $M^{11}$ and $M^{21}$ each represent a cation or an acid anion. The cation may include, for example, protons, organic ammonium ions as exemplified by ions such as triethylammonium and triethanolammonium, inorganic cations as exemplified by cations such as lithium, sodium and calcium. The acid anions may include, for example, halogen ions as exemplified by chloride ions, bromide ions and iodide ions, p-toluenesulfonate ions, perchlorate ions and boron tetrafluoride ions. $n^1$, $n^{11}$ and $n^{21}$ are each 0 (zero) when they form interal salts and charges are neutralized.

In Formula S-I set out above, compounds wherein $R^1$ is an alkyl group having a sulfo group and at least two of R, $R^2$ and $R^3$ are each a carboxymethyl group are preferred.

In Formula S-II set out above, compounds wherein $W^{11}$ is an oxygen atom, $Z^{11}$ and $Z^{12}$ each form a condensed benzene ring, and both $R^{11}$ and $R^{12}$ are alkyl group having a sulfo group, or any one of $R^{11}$ and $R^{12}$ is an alkyl group having a sulfo group and the other is a carboxymethyl group, are preferred.

In Formula S-III set out above, compounds wherein $W^{21}$ and $W^{22}$ are each a sulfur atom, $Z^{11}$ and $Z^{12}$ each form a condensed naphthalene ring and $R^{23}$ is an alkyl group or a heterocyclic group are preferred.

As an embodiment of the present invention, the present invention can be particularly well effective when compounds respectively selected at least one by one from the compounds represented by Formulas S-I, S-II and S-III are used in combination.

Examples of the spectral sensitizing dyes represented by Formulas S-I, S-II and S-III are shown below, which are S-1 ff., SS-1 ff., and SA-1 ff., respectively.

S-1

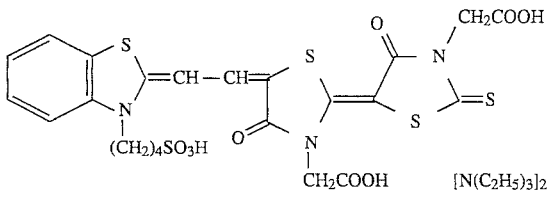

S-2

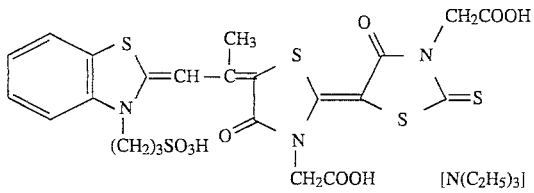

S-3

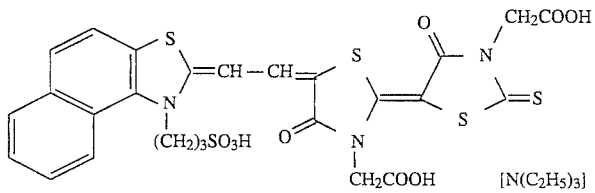

S-4

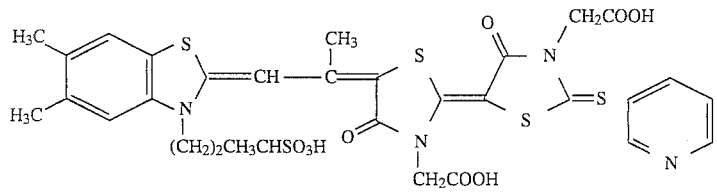

-continued
S-5
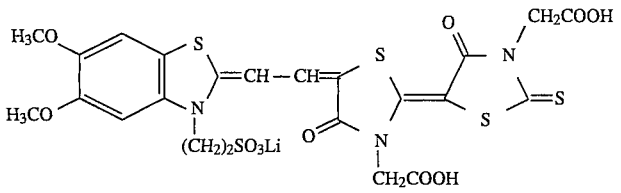
S-6
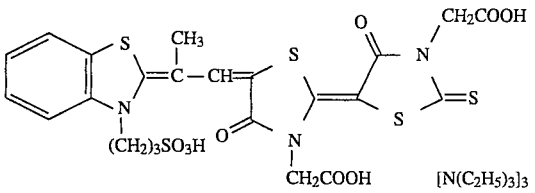
S-7
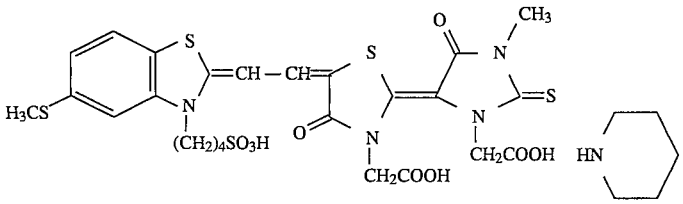
S-8
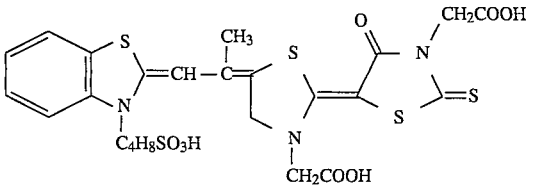
S-9
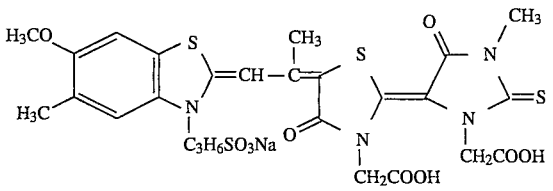
S-10
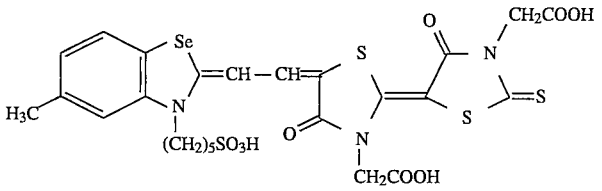
S-11
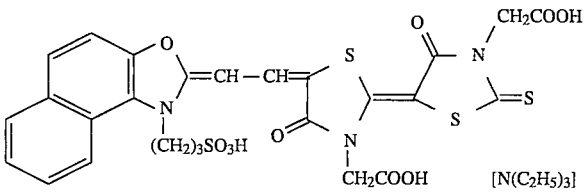
S-12
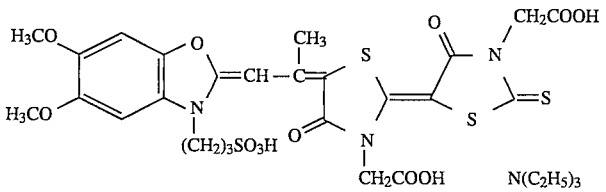

-continued
S-13
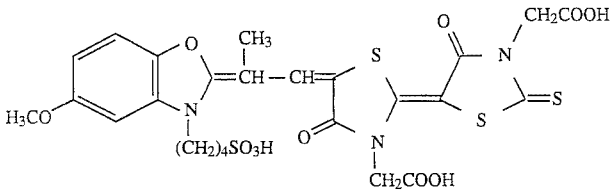
S-14
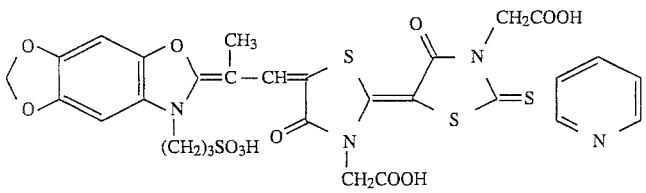
S-15
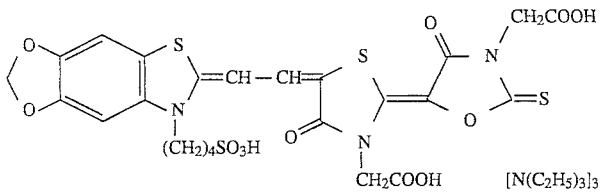
S-16
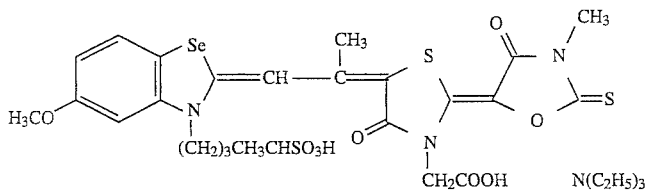
S-17
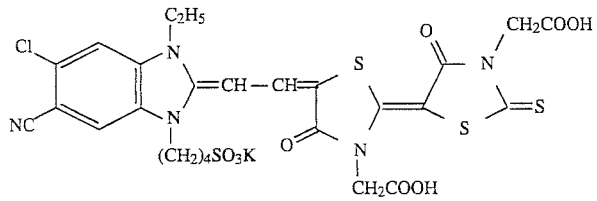
S-18
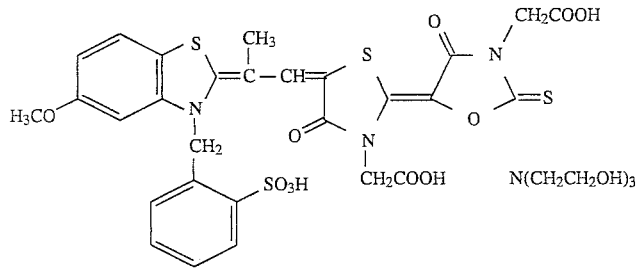
S-19
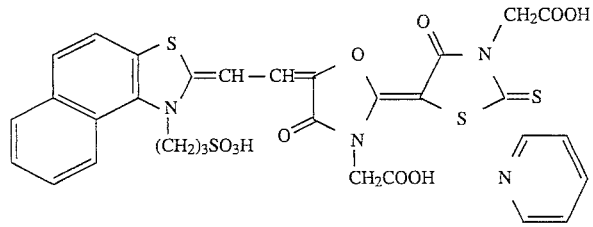

-continued
S-20
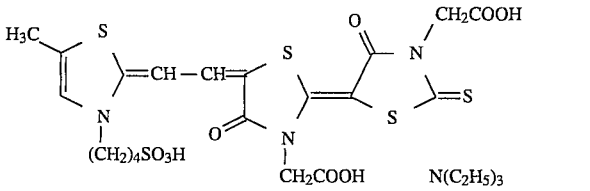
S-21
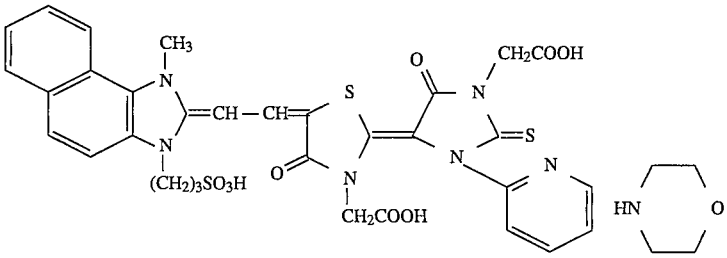
SS-1
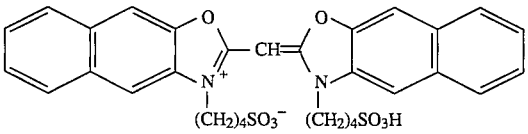
SS-2
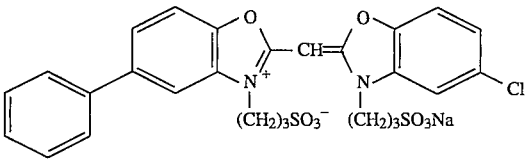
SS-3
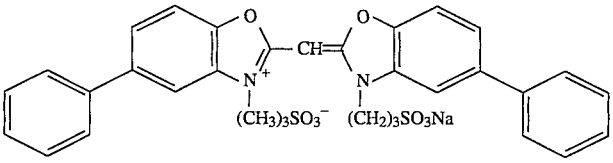
SS-4
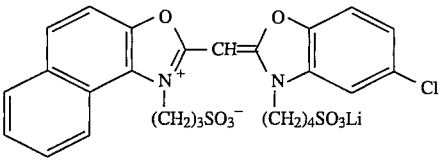
SS-5
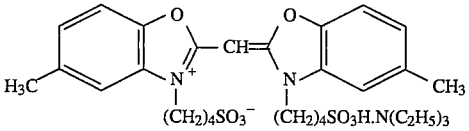
SS-6
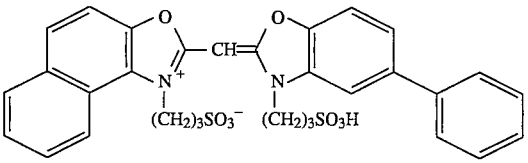
SS-7
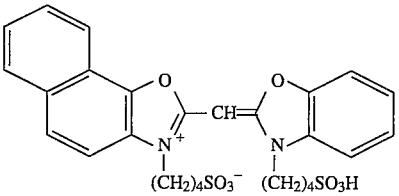

-continued
SS-8
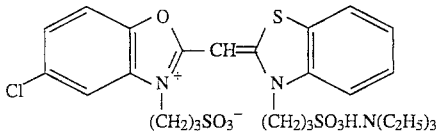
SS-9
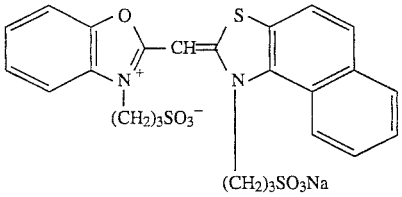
SS-10
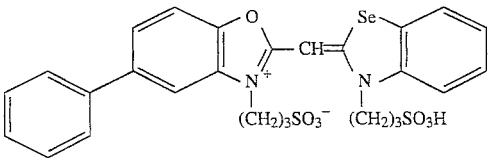
SA-1
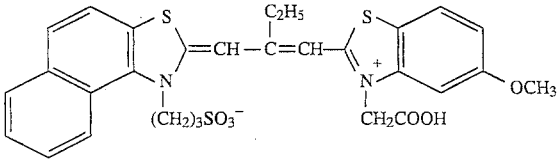
SA-2
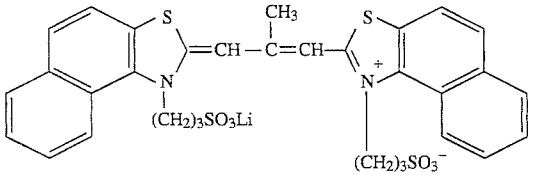
SA-3
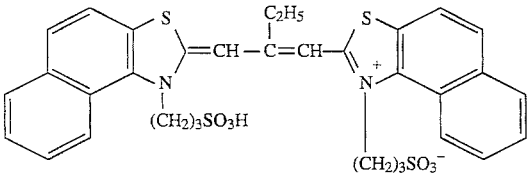
SA-4
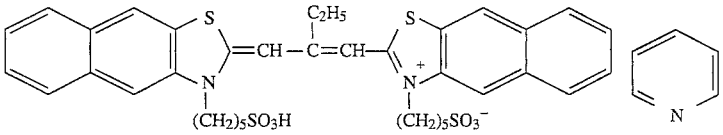
SA-5
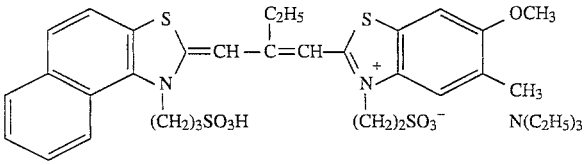
SA-6
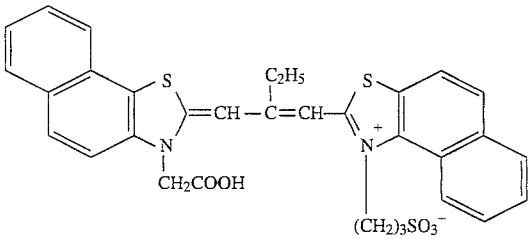

-continued
SA-7
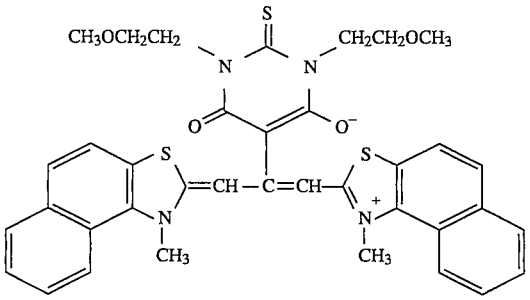
SA-8
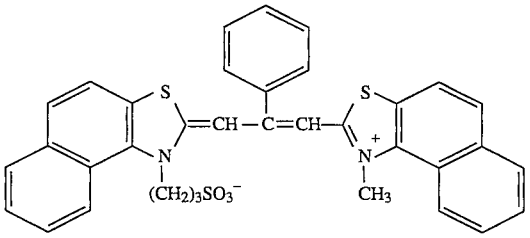
SA-9
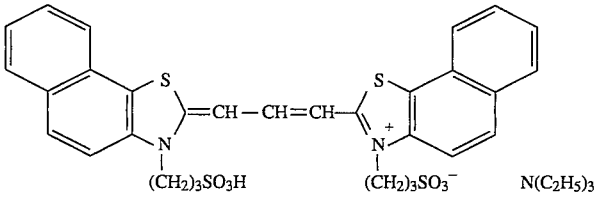
SA-10
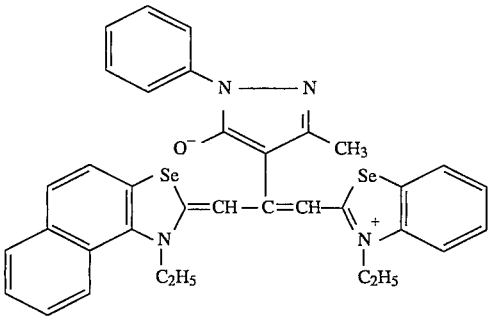
SA-11
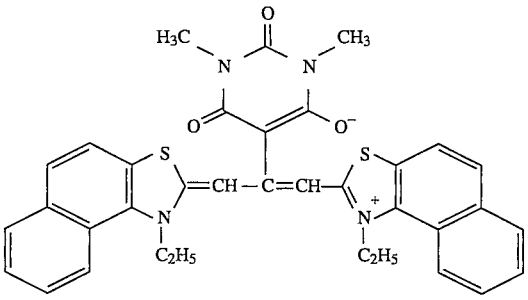

-continued

SA-12

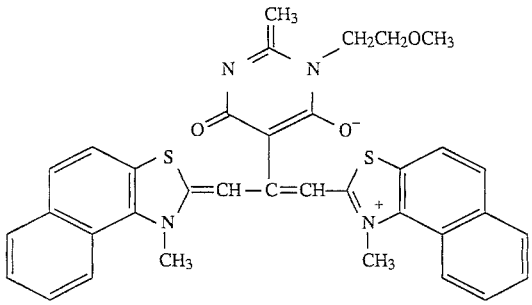

SA-13

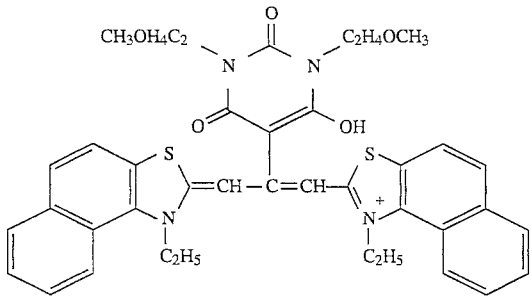

SA-14

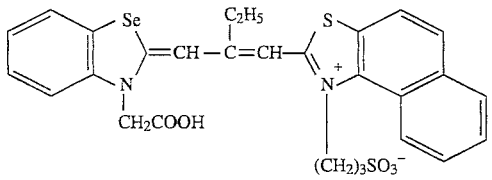

The compounds according to the present invention can be readily synthesized making reference to conventionally known methods as disclosed, e.g., in F. M. Hamer, "Cyanine Dyes And Related Compounds", 1964, Interscience Publishers, and U.S. Pat. No. 2,454,629 and No. 2,493,748.

The compounds according to the present invention may be added in an amount, which is greatly variable depending on the conditions under which they are used and the types of emulsions, of preferably from $1\times10^{-6}$ to $5\times10^{-3}$ mol, and more preferably from $2\times10^{-6}$ to $2\times10^{-3}$ mol, for each compound/in total, per mol of silver halide.

With regard to combination of amounts in which the compounds according to the present invention are added for supersensitization, it may be selected so that the compounds of Formula S-I and Formula S-II are added within a range of molar ratio of from 1:(10 to 0.1), and a combination in which the compounds of Formula S-I, Formula S-II and Formula S-III are added in a molar ratio of from 1:(10 to 0.1): (2.0 to 0.1) is preferred.

The compounds represented by Formulas S-I, S-II and S-III, used in the present invention, may be added to emulsions by conventionally known methods. For example, they are added to emulsions by the method in which compounds are added by proton-forming dissolution, as disclosed in Japanese Patent O.P.I. Publications No. 80826/1975 and No. 80827/1975, the method in which they are dispersingly added together with a surface active agent, as disclosed in U.S. Pat. No. 3,822,135 and Japanese Patent O.P.I. Publication No. 11419/1975, the method in which they are added after dispersed in a hydrophilic substrate, as disclosed in U.S. Pat. No. 3,676,147, No. 3,469,987 and No. 4,247,627 and Japanese Patent O.P.I. Publications No. 59942/1976, No. 16624/1978, No. 102732/1988, No. 102733/1988 and No. 137131/1988, the method in which they are added in the form of a solid solution, as disclosed in East German Patent No. 143,324, or the method in which they are added after dissolved in a water-soluble solvent capable of dissolving dyes (e.g., a low-boiling solvent such as water, methanol, ethanol, propyl alcohol, acetone or fluorinated alcohol, or a high-boiling solvent such as dimethylformamide, methyl cellosolve or phenyl cellosolve, alone or in the form of a mixed solvent of any of these, as typically disclosed in Research Disclosure No. 21802, Japanese Patent Examined Publication No. 40659/1975 and Japanese Patent O.P.I. Publication No. 148053/1984. Any of these methods may be arbitrarily selected and used.

The compounds of the present invention represented by the formulas previously set out may be added at any stage in the course of emulsion preparation of from physical ripening to completion of chemical ripening and before coating. They may preferably be added in the course of from physical ripening to completion of chemical ripening.

When the compounds according to the present invention are added during physical ripening, or before the addition of a chemical sensitizer or immediately after the addition of a chemical sensitizer in the step of chemical ripening, a higher spectral sensitivity can be obtained. Hence, such a manner of addition is preferably used.

The spectral sensitizing dyes used in the present invention can achieve a much higher spectral sensitivity when used in combination with a compound capable of bringing about the action of supersensitization. Such a compound capable of bringing about the action of supersensitization may include the compounds having a pyrimidinylamino group or a triazinylamino group, as disclosed in U.S. Pat. No. 2,933,390, No. 3,416,927, No. 3,511,664, No. 3,615,613, No.

3,615,632 and No. 3,635,721 and Japanese Patent O.P.I. Publications No. 15042/1991, No. 110545/1991 and No. 255841/1992, the aromatic organic formaldehyde condensates as disclosed in British Patent No. 1,137,580 and Japanese Patent O.P.I. Publication No. 169833/1986, the calix arene derivatives as disclosed in Japanese Patent O.P.I. Publication No. 184332/1992, the halogenated benzotriazole derivatives as disclosed in U.S. Pat. No. 4,030,927, the bispyridinium compounds as disclosed in Japanese Patent O.P.I. Publications No. 142541/1984 and No. 188641/1984, the aromatic heterocyclic quaternary salt compounds as disclosed in Japanese Patent O.P.I. Publication No. 191032/1984, the electron donative compounds as disclosed in Japanese Patent O.P.I. Publication No. 79348/1985, the polymers containing an aminoallylidene malononitirle unit, as disclosed in U.S. Pat. No. 4,307,183, hydroxytetrazaindene derivatives as disclosed in Japanese Patent O.P.I. Publication No. 149937/1992, the 3-oxadiazole derivatives as disclosed in U.S. Pat. No. 3,615,633, and the amino-1,2,3.4-thiatriazole derivatives as disclosed in U.S. Pat. No. 4,780,404. There are no particular limitations on the time for the addition of these supersensitizers. They may be arbitrarily added according to the time for the addition of the spectral sensitizing dyes. They may each be added in an amount selected within the range of from $1\times10^{-6}$ to $1\times10^{-1}$ mol per mol of silver halide, and be used in an addition molar ratio of from 1:10 to 10:1 with respect to the spectral sensitizing dyes.

Silver halide grains may be cubic grains, octahedral grains, or tabular grains with an aspect ratio of 5 or more, any of which may be used. Monodisperse grains in which a variation coefficient as expressed by (standard deviation of grain size)/(average value of grain size)×100 is 15% or less are preferred.

There are no particular limitations on the average grain size of the silver halide grains. It may be in the range of from 0.05 to 2.0 μm, and preferably from 0.1 to 1.0 μm.

As hydrophilic protective colloids used to prepare the light-sensitive silver halide photographic material of the present invention, gelatin used in usual silver halide emulsions may be used. Besides, gelatin derivatives such as acetylated gelatin and phthalated gelatin, water-soluble cellulose derivatives and other synthetic or naturally occurring hydrophilic polymers may also be used.

In the light-sensitive silver halide photographic material according to the present invention, various additives known in the present industrial field can be optionally used according to its layer configuration. For example, the light-sensitive material may comprise a support and provided thereon with photographic component layers, including light-sensitive silver halide emulsion layers, and auxiliary layers such as a protective layer, a filter layer, an anti-halation layer, a cross-over light cutting layer and a backing layer, and these layers may be incorporated with various types of chemical sensitizers, noble metal sensitizers, couplers, high-boiling solvents, antifoggants, stabilizers, development restrainers, bleach accelerators, fixing accelerators, anti-color-mixing agents, formalin scavengers, toning agents, hardening agents, surface active agents, thickening agents, plasticizers, lubricants, ultraviolet absorbants, anti-irradiation agents, filter light absorbing dyes, polymer latexes, heavy metals, antistatic agents, matting agents, and contrast increasing agents such as tetrazolium compounds and hydrazine compounds by various methods.

Materials for the support that can be used in the light-sensitive silver halide photographic material of the present invention may include cellulose triacetate, cellulose nitrate, polyesters such as polyethylene terephthalate, polyolefins such as polyethylene, polystyrene, baryta paper, polyethylene-laminated paper, glass and metals. These supports are optionally subjected to subbing.

The additives enumerated above are more detailed in Research Disclosures Vol. 176, Item 17643 (December, 1978), Vol. 184, Item 18431 (August, 1979), and Vol. 187, Item 18716 (November, 1979).

To develop the light-sensitive silver halide photographic material of the present invention, the developing agents as disclosed in T. H. James, The Theory of the Photographic Process, Fourth Edition, pages 291–334, and Journal of the American Chemical Society, Vol. 73, page 3,100 (1951) can be effectively used.

EXAMPLES

The present invention will be more specifically described below by giving Examples. Embodiments of the present invention are by no means limited to these.

Example 1

Preparation of silver halide emulsion A:

Using a silver iodobromide seed emulsion with an average grain size of 0.1 μm (silver iodide content: 2 mol %), an aqueous ammoniacal silver nitrate solution and an aqueous potassium bromide solution were added by double jet precipitation to grow cubic monodisperse emulsion grains comprising silver iodobromide with an average grain size of 0.25 μm (average silver iodide content: 0.1 mol %), followed by desalting by flocculation using a modified gelatin treated with phenyl isocyanate, and then the emulsion was dispersed in gelatin. Its variation coefficient ($\sigma/\rho$) was 0.17.

To this emulsion, citric acid and sodium chloride were added to adjust its pH and pAg to 5.8 and 7.0, respectively. Thereafter, the dye(s) as shown in Table 1 was/were added, followed by chemical ripening to an optimum at 60° C. using ammonium thiocyanate, sodium thiosulfateopentahydrate and chloroauric acid, and then addition of 4-hydroxy-6-methyl-1,3,3a,7-tetrazaindene in an amount of 600 mg per mol of silver to stop the ripening.

Preparation of silver halide emulsion B:

An aqueous silver nitrate solution, an aqueous potassium bromide solution and an aqueous potassium chloride solution were added by double jet precipitation to grow grains, followed by desairing by flocculation using a modified gelatin treated with phenyl isocyanate, and then the emulsion was dispersed in gelatin. Thus, an emulsion comprising cubic monodisperse grains (variation coefficient: 0.1) of silver chloroiodobromide with an average grain size of 0.25 μm (silver chloride content: 60 mol %; silver iodide content: 0.5 mol %; the balance: silver bromide) was obtained.

To this emulsion, citric acid and sodium chloride were added to adjust its pH and pAg to 5.8 and 7.0, respectively. Thereafter, the dye(s) as shown in Table 1 was/were added, followed by chemical ripening to an optimum at 60° C. using ammonium thiocyanate, sodium thiosulfate-pentahydrate and chloroauric acid, and then addition of 4-hydroxy-6-methyl-1,3,3a,7-tetrazaindene in an amount of 600 mg per mol of silver to stop the ripening.

Preparation of light-sensitive silver halide photographic materials:

To provide a backing layer, a backing layer solution was prepared, comprising 400 g of gelatin, 2 g of polymethyl methacrylate with an average particle diameter of 6 μm, 24 g of potassium nitrate, 6 g of sodium dodecylbenzenesulfonate, 2 g/m$^2$ of a dye emulsified dispersion containing 20 g of an anti-halation dye F-I shown below, and glyoxal as a hardening agent, and coated together with a protective layer solution comprising gelatin, a matting agent, glyoxal and sodium dodecylbenzenesulfonate, on one side of a polyethylene terephthalate support having been coated with, as a subbing solution, an aqueous copolymer dispersion obtained by diluting a glycidyl methacrylate/methyl acrylate/butyl methacrylate copolymer (weight ratio: 50:10:40) so as to be in a concentration of 10% by weight. Thus, a support having been back-coated was prepared. The backing layer solution and the protective layer solution were each coated so as to be in a coating weight of 2.0 g/m$^2$ as gelatin coating weight.

On the back-coated support thus obtained, an emulsion coating solution and a protective layer solution each formulated as shown below were simultaneously double-layer coated. Samples Nos. 1 to 39 were obtained in this way.

The silver halide emulsion layer thus formed was in a coating weight of 3.0 g/m$^2$ in terms of silver weight and in a gelatin weight of 2.5 g/m$^2$. The protective layer was in a gelatin weight of 1.2 g/m$^2$.

Composition (1)

Silver Halide Emulsion Layer Composition

| | |
|---|---|
| Gelatin | 2.5 g/m$^2$ |
| Silver halide emulsion A and B | 3.0 g/m$^2$ |
| (The following amounts of additives are indicated in weight per mol of silver halide) | |
| Nitrophenyl-triphenylphosphonium chloride | 30 mg |
| Ammonium 1,3-dihydroxybenzene-4-sulfonate | 1.0 g |
| Sodium 2-mercaptobenzimidazolo-5-sulfonate | 10 mg |
| 2-Mercaptobenzothiazole | 10 mg |
| Trimethylolpropane | 9.0 g |
| 1,1-Dimethylol-1-bromo-1-nitromethane | 10 mg |
| $C_4H_9OCH_2(OH)CH_2N(CH_2COOH)_2$ | 1.0 g |
| Restrainer: ST-1 | 35 mg |
| Restrainer: ST-2 | 60 mg |

Composition (2)

Emulsion Protective Layer Composition

| | |
|---|---|
| Gelatin (lime-treated inert gelatin:acid-treated gelatin, 97:3) | 1.2 g/m$^2$ |
| (The following amounts of additives are indicated in weight per liter of the coating solution) | |
| Surface active agent: SAA-1 | 1.0 g |
| Matting agents: | |
| 4 μm Polymethyl methacrylate particles | 0.5 g |
| Silica with an average particle diameter of | 1.2 μm |
| LUDOX-AM (trade name; collidal silica available from Du Pont Co.) | 30.0 g |
| Hardening agents: | |
| 1,3-vinylsulfonyl-2-propanol (aqueous 2% solution) | 10.0 ml |
| Formalin (aqueous 35% solution) | 2.0 ml |
| Glyoxal (aqueous 40% solution) | 1.5 ml |

F-1

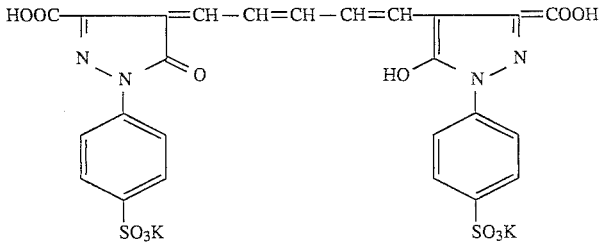

ST-1

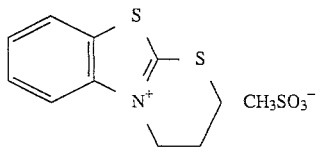

ST-2

-continued

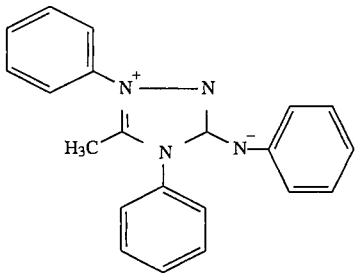

SAA-1

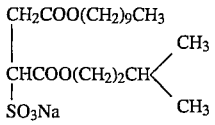

Comparative Compounds:

(I)

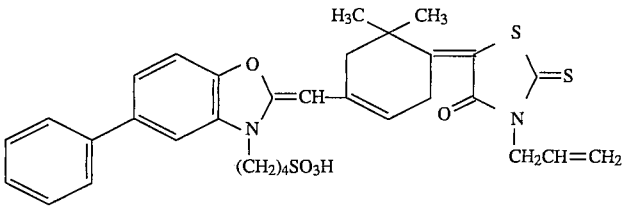

(II)

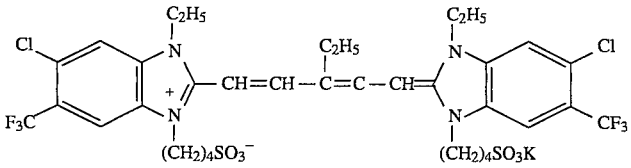

(III)

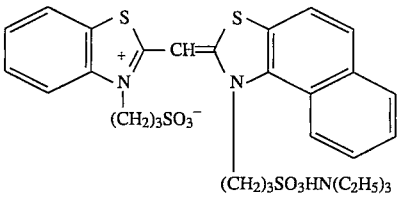

(IV)

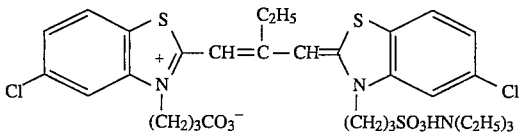

Evaluation of Photographic Performance

A wedge was brought into close contact with each sample obtained, which was then exposed to light through Wratten filter No. 21 for 10–5 second. The samples were processed under conditions shown below, using a rapid processing automatic processor SRX-502, manufactured by Konica Corporation, in which a developing solution and a fixing solution each having composition shown below were applied.

The resulting samples were each set on an optical densitometer KONICA PDA-65 to measure sensitivity as a reciprocal of the amount of exposure at a fog density +1.0, which was indicated as a relative value assuming the sensitivity of sample No. 1 as 100. With regard to the residual color, unexposed films were subjected to developing and fixing, and any residual color visually observed when five films thus processed were superposed was evaluated according to a five-rank system.

Samples completely free from residual color was evaluated as "5" as the highest rank, and the rest was evaluated as "4", "3", "2" and "1" with ranks lowered in order, according to the degrees at which the residual color appeared. Those evaluated as rank "2" or "1" are at the level unpreferable in practical use.

Preparation of processing solutions:

Developing Solution A

| Part-A | |
|---|---|
| Potassium hydroxide | 1,140 g |
| Potassium sulfite | 2,451 g |
| Sodium hydrogencarbonate | 380 g |
| Boric acid | 38 g |
| Diethylene glycol | 418 g |
| Pentasodium diethylenetriaminepentaacetate | 61 g |
| 5-Methylbenzotriazole | 1.9 g |
| Hydroquinone | 1,064 g |
| By adding water, made up to | 9.3 lit. |
| Part-B (for making up to 38 lit.) | |
| Glacial acetic acid | 562 g |
| Triethylene glycol | 418 g |
| 1-Phenyl-3-pyrazolidone | 100 g |
| 5-Nitroindazole | 9.5 g |

Mixing of both parts:

In a 50 liter tank, 20 liter of 25° C. water was put, and Part-A shown above was charged with stirring, followed by addition of Part-B. The mixed parts were finally made up to 38 liter by adding water. The developing solution thus obtained was left to stand for 24 hours at 25° C., and thereafter adjusted to have a pH of 10.53 at 25° C. using potassium hydroxide or acetic acid.

Developing Solution B

In the preparation of developing solution A, a solution not containing 266 g of of glutaldehyde (aqueous 50% solution) was added as Part-C after Part-B was added. In order to adjust the pH, the amount of potassium hydroxide was increased.

Starter

| | |
|---|---|
| Glacial acetic acid | 230 g |
| Potassium bromide | 200 g |
| By adding water, made up to | 1.5 lit. |

As a replenishing solution, the above developing solution B was used as it was. To the solution in the developing tank at the start of its use, the above starter was added in an amount of 20 ml per liter of the developing solution when used.

The developing replenishing solution was supplied in an amount of 250 ml per 1 $m^2$ of the sample.

Formulation of Fixing Solution

| Part-A (for making up to 38 lit.) | |
|---|---|
| Ammonium thiosulfate | 6,080 g |
| Disodium ethylenediaminetetraacetate | 0.76 g |
| Sodium sulfite | 456 g |
| Boric acid | 266 g |
| Sodium hydroxide | 190 g |
| Glacial acetic acid | 380 g |
| By adding water, made up to | 9.5 lit. |
| Part-B (for making up to 38 lit.) | |
| Aluminum sulfate (in terms of anhydrous salt) | 380 g |
| Sulfuric acid (50 wt. %) | 228 g |
| By adding water, made up to | 1.9 lit. |

Mixing of both parts:

In a 50 liter tank, 20 liter of 25° C. water was put, and Part-A shown above was charged with stirring, followed by addition of Part-B. The mixed parts were finally made up to 38 liter by adding water and adjusted to have a pH of 4.30 at 25° C. by adding acetic acid. ($Al^{3+}$ was in a content of 58.5 mmol per liter of the fixing solution.)

Photographic Processing

The samples were photographically processed on an automatic processor SRX-502, using the developing solution and fixing solution shown above at a developing temperature of 35° C. and a fixing temperature of 33° C.

Results obtained are shown in the following tables.

TABLE 1

| | | Spectral sensitizing dyes (amount: × $10^{-4}$ mol/mol · Ag) | | |
|---|---|---|---|---|
| Sample No. | Emulsion | S-I | S-II | S-III |
| 1 | A | S-2 (3.2) | — | — |
| 2 | A | S-2 (1.6) | — | — |
| 3 | A | S-2 (1.6) | SS-3 (1.6) | — |
| 4 | A | S-2 (1.6) | SS-3 (1.6) | SA-3 (0.8) |
| 5 | A | S-3 (3.2) | — | — |
| 6 | A | S-3 (1.6) | SS-3 (1.6) | SA-3 (0.8) |
| 7 | A | S-3 (1.6) | SS-4 (1.6) | SA-5 (0.8) |
| 8 | A | S-6 (3.2) | — | — |
| 9 | A | S-6 (1.6) | SS-5 (1.6) | SA-5 (0.8) |
| 10 | A | S-14 (3.2) | — | — |
| 11 | A | S-14 (1.6) | — | — |
| 12 | A | S-14 (1.6) | SS-9 (1.6) | — |
| 13 | A | S-14 (1.6) | SS-9 (1.6) | SA-7 (0.8) |
| 14 | A | S-14 (1.6) | (III) (1.6) | — |
| 15 | A | S-14 (1.6) | SS-9 (1.6) | (IV) (0.8) |
| 16 | A | (I) (3.2) | — | — |
| 17 | A | (I) (1.6) | — | — |
| 18 | A | (I) (1.6) | SS-4 (1.6) | — |
| 19 | A | (I) (1.6) | SS-4 (1.6) | SA-6 (0.8) |
| 20 | A | (II) (1.6) | — | — |
| 21 | A | (II) (1.6) | SS-3 (1.6) | — |
| 22 | A | (II) (1.6) | SS-3 (1.6) | SA-3 (0.8) |
| 23 | B | S-2 (3.2) | — | — |
| 24 | B | S-2 (1.6) | — | — |
| 25 | B | S-2 (1.6) | SS-6 (1.6) | — |
| 26 | B | S-2 (1.6) | SS-6 (1.6) | SA-10 (0.8) |
| 27 | B | S-3 (1.6) | — | — |
| 28 | B | S-3 (1.6) | SS-7 (1.6) | — |
| 29 | B | S-8 (1.6) | — | — |
| 30 | B | S-8 (1.6) | SS-8 (1.6) | — |
| 31 | B | S-15 (1.6) | — | — |
| 32 | B | S-15 (1.6) | SS-3 (1.6) | SA-3 (0.8) |
| 33 | B | S-15 (1.0) | SS-3 (1.2) | SA-3 (0.5) |
| 34 | B | (I) (1.6) | — | — |
| 35 | B | (I) (1.6) | SS-3 (1.6) | |

TABLE 1-continued

| Sample No. | Emulsion | Spectral sensitizing dyes (amount: × $10^{-4}$ mol/mol · Ag) S-I | S-II | S-III |
|---|---|---|---|---|
| 36 | B | (I) (1.6) | SS-3 (1.6) | SA-3 (0.8) |
| 37 | B | (II) (1.6) | — | — |
| 38 | B | (III) (1.6) | SS-6 (1.6) | — |
| 39 | B | (II) (1.6) | SS-6 (1.6) | SA-13 (0.8) |

TABLE 2

| Sample No. | Photographic performance Sensitivity | Fog | Rank of residual color | Remarks |
|---|---|---|---|---|
| 1 | 100 | 0.04 | 3.5 | X |
| 2 | 92 | 0.04 | 5.0 | " |
| 3 | 117 | 0.04 | 5.0 | Y |
| 4 | 146 | 0.04 | 4.0 | " |
| 5 | 105 | 0.04 | 3.0 | X |
| 6 | 158 | 0.04 | 3.5 | Y |
| 7 | 146 | 0.05 | 3.5 | " |
| 8 | 102 | 0.04 | 3.5 | X |
| 9 | 149 | 0.04 | 4.0 | Y |
| 10 | 106 | 0.04 | 3.5 | X |
| 11 | 99 | 0.04 | 5.0 | " |
| 12 | 124 | 0.04 | 5.0 | Y |
| 13 | 149 | 0.04 | 4.0 | " |
| 14 | 100 | 0.04 | 5.0 | X |
| 15 | 126 | 0.05 | 4.0 | " |
| 16 | 79 | 0.05 | 2.5 | " |
| 17 | 79 | 0.04 | 3.5 | " |
| 18 | 76 | 0.04 | 3.5 | " |
| 19 | 94 | 0.06 | 3.0 | " |
| 20 | 91 | 0.05 | 2.5 | " |
| 21 | 94 | 0.05 | 2.5 | X |
| 22 | 104 | 0.05 | 2.0 | " |
| 23 | 103 | 0.05 | 3.5 | " |
| 24 | 98 | 0.05 | 5.0 | " |
| 25 | 122 | 0.05 | 5.0 | Y |
| 26 | 151 | 0.05 | 4.0 | " |
| 27 | 100 | 0.05 | 4.5 | X |
| 28 | 127 | 0.05 | 4.5 | Y |
| 29 | 89 | 0.05 | 5.0 | X |
| 30 | 116 | 0.05 | 5.0 | Y |
| 31 | 94 | 0.05 | 5.0 | X |
| 32 | 146 | 0.05 | 4.0 | Y |
| 33 | 123 | 0.05 | 4.5 | " |
| 34 | 76 | 0.06 | 3.5 | X |
| 35 | 78 | 0.06 | 3.5 | " |
| 36 | 97 | 0.07 | 3.0 | " |
| 37 | 90 | 0.06 | 2.5 | " |
| 38 | 93 | 0.06 | 2.5 | " |
| 39 | 105 | 0.07 | 2.0 | " |

X: Comparative Example, Y: Present Invention

As is clearly seen from the foregoing tables, compared with comparative samples, the samples according to the present invention have a low fog and a high sensitivity and can obtain good photographic performance. The sensitization can be more effective especially when the dye represented by Formula S-I is used in combination with the dyes represented by Formulas S-II and S-III. It is also seen that the combination of dyes according to the present invention cause less residual color stain in all instances compared with the combination for comparison.

Example 2

Preparation of Silver Halide Emulsion

A silver chloroiodobromide emulsion (62 mol % of silver chloride, 0.5 mol % of silver iodide and the balance of silver bromide per mol of silver) was prepared by double jet precipitation.

At the step of precipitation after the formation of grains by 5% of the finally intended average grain size until the formation of grains with the finally intended average grain size, $K_2IrCl_6$ was added in an amount of $8\times10^{-7}$ mol per mol of silver. After desalted by flocculation using a modified gelatin treated with phenyl isocyanate, the emulsion was dispersed in gelatin, followed by addition of a mixture of compounds A, B and C shown below, as antifungal agents. Thus, an emulsion comprising cubic monodisperse grains with an average grain size of 0.2 μm (variation coefficient: 0.1) was obtained.

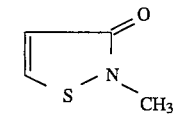
(A)

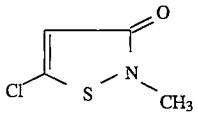
(B)

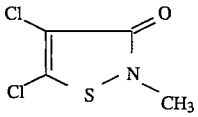
(C)

This emulsion was adjusted to have a pH and pAg of 5.8 and 7.0, respectively, using citric acid and sodium chloride, and thereafter subjected to chemical ripening to an optimum at 60° C. using sodium thiosulfate,pentahydrate and chloroauric acid, followed by addition of 1-phenyl-5-mercaptotetrazole and 4-hydroxy-6-methyl-1,3,3a,7-tetrazaindene in amounts of 60 mg and 600 mg, respectively, per mol of silver to stop the ripening.

Preparation of light-sensitive silver halide photographic materials:

On one of undercoat layers of a 10 μm thick polyethylene terephthalate film having been provided with 0.1 μm thick undercoat layers (see Example 1 of Japanese Patent O.P.I. Publication No. 19941/1984) on its both sides, a silver halide emulsion layer with the following formulation (1) was provided so as to be in a gelatin weight of 2.0 g/$m^2$ and a silver weight of 3.2 g/$m^2$, and an emulsion protective layer with the following formulation (2) was further provided thereon so as to be in a gelatin weight of 1.0 g/$m^2$. On the other undercoat layer on the opposite side, a backing layer, was also provided so as to be in a gelatin weight of 2.4 g/$m^2$ according to the following formulation (3), and a backing protective layer with the following formulation (4) was further provided thereon so as to be in a gelatin weight of 1.0 g/$m^2$. Thus, samples Nos. 40 to 67 were obtained. (In the following, each amount is indicated in weight per 1 $m^2$ of the light-sensitive material.)

Composition (1)

Silver Halide Emulsion Layer Composition (The following amounts are indicated in weight per mol of the light-sensitive material)

| | |
|---|---|
| Gelatin | 2.0 g |
| Silver halide emulsion | 3.2 g |
| Spectral sensitizing dye: Compounds of the invention or comparative compound (as shwonin Table 3) | |
| Stabilizer: 4-Methyl-6-hydroxy-1,3,3a,7-tetrazaindene | 30 mg |
| Antifoggant: Adenine | 10 mg |
| Antifoggant: 1-Phenyl-5-mercaptotetrazole | 5 mg |
| Surface active agent: Saponin | 0.1 g |
| Surface active agent: SAA-1 | 8 mg |
| Hydrazine derivative: NU-1 | 35 mg |
| Nucleation accelerator: NA-1 | 70 mg |
| Latex polymer: Lx-1 | 1.0 g |
| Nonylphenol-polyethylene oxide (EO = 35) | 0.1 g |
| Hardening agent: HD-1 | 60 mg |

NU-1

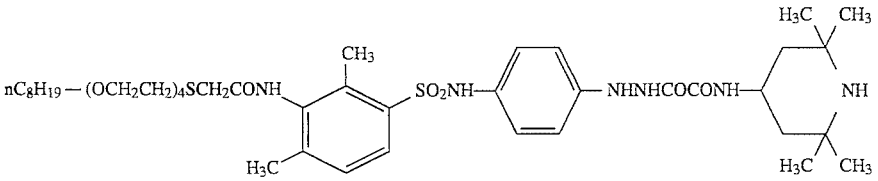

NA-1

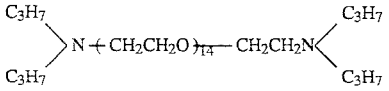

Lx-1

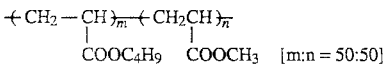

HD-1

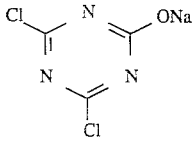

Composition (2)

Emulsion Protective Layer Composition

| | |
|---|---|
| Gelatin | 0.9 g |
| Surface active agent: SAA-2 | 10 mg |
| Surface active agent: SAA-3 | 10 mg |
| Matting agent: | |
| Monodisperse silica with an average particle diameter of 3.5 μm | 3 mg |
| Hardening agent: 1,3-Vinylsulfonyl-2-propanol | 40 mg |

SAA-2

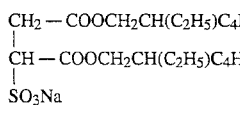

SAA-3

-continued

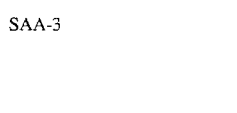

Composition (3)

Backing Layer Composition

| | |
|---|---|
| Gelatin | 2.4 g |
| Surface active agent: Saponin | 0.1 g |
| Surface active agent: SAA-1 | 6 mg |
| Colloidal silica | 100 mg |
| Coloring dye: F-2 | 30 mg |
| Coloring dye: F-3 | 75 mg |

-continued

| | |
|---|---|
| Coloring dye: F-4 | 30 mg |

F-2

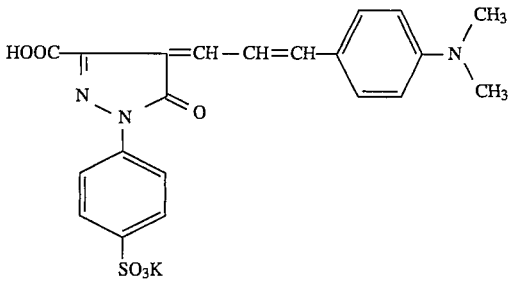

F-3

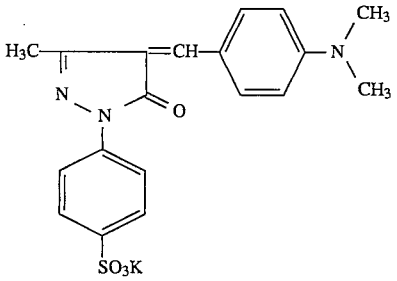

F-4

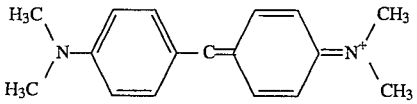

Comparative Compound:

(V)

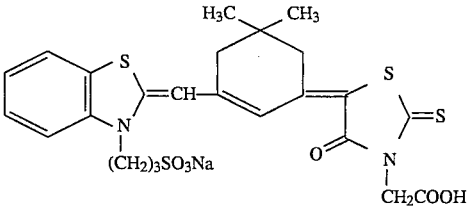

Composition (4)

Backing Protective Layer Composition

| | |
|---|---|
| Gelatin | 1.0 g |
| Surface active agent: SAA-2 | 10 mg |
| Matting agent: Monodisperse polymethyl methacrylate with an average particle diameter of 5.0 μm | 50 mg |
| Hardening agent: Glyoxal | 35 mg |

The samples thus obtained were divided into two groups, one group samples of which were used as they were and the other group samples of which were left to stand in an environment of 50° C. and 20%RH to make thermostatic aging tests in order to evaluate their stability in an environment of high temperature (evaluation of photographic performance).

A wedge was brought into close contact with each sample obtained, which was then exposed to light through Wratten filter No. 21 for $10^{-5}$ second. The samples were processed under conditions shown below, using a rapid processing automatic processor GR-26S, manufactured by Konica Corporation, in which a developing solution and a fixing solution each having composition shown below were applied.

The resulting samples were each set on an optical densitometer KONICA PDA-65 to measure sensitivity as a reciprocal of the amount of exposure at a fog density +3.0, which was indicated as a relative value assuming the sensitivity of sample No. 40 obtained immediately after coating and drying. The γ (gamma) in the following table represents a slope of the straight-line portion of the characteristic curve. The larger the numerical value is, the higher contrast images can be obtained.

Developing Solution Composition

| | |
|---|---|
| Potassium sulfite | 60.0 g |
| Hydroquinone | 15.0 g |
| 4-Methyl-4-hydroxymethyl-1-phenyl-3-pyrazolidone | 1.0 g |
| Disodium ethylenediaminetetraacetate | 0.5 g |
| Potassium carbonate | 50.0 g |
| Potassium bromide | 5.0 g |
| 2-Mercaptobenzoimidazole | 0.25 g |
| 5-Methylbenzotriazole | 0.4 g |

Made up to 1 liter by adding water, and adjusted to pH 10.5 using potassium hydroxide.

Formulation of Fixing Solution—Composition A:

| | |
|---|---|
| Ammonium thiosulfate (aqueous 7.5% w/v solution) | 240 ml |
| Sodium sulfite | 17.0 g |
| Sodium acetate, trihydrate | 6.5 g |
| Boric acid | 6.0 g |
| Sodium citrate, dihydrate | 20 g |

Composition B:

| | |
|---|---|
| Pure water (ion-exchanged water) | 17 ml |
| Sulfuric acid (aqueous 50% w/v solution) | 4.7 g |
| Aluminum sulfate (aqueous 8.1% w/v solution in terms of $Al_2O_3$) | 8.5 g |

The composition A and composition B were dissolved in this order in 500 ml of water when the fixing solution was used. The pH of this fixing solution was adjusted to 4.8 with acetic acid.

| - Processing Conditions - | | |
|---|---|---|
| Steps | Temperature | Time |
| Developing | 35° C. | 30 seconds |
| Fixing | 35° C. | 20 seconds |
| Washing | 30° C. | 15 seconds |
| Drying | 50° C. | 15 seconds |

Results obtained are shown in the following tables.

TABLE 3

| Sample No. | Emulsion | Spectral sensitizing dyes (amount: × $10^{-4}$ mol/mol · Ag) S-I | S-II | S-III |
|---|---|---|---|---|
| 40 | A | S-1 (1.7) | — | — |
| 41 | A | S-1 (1.7) | SS-2 (2.1) | — |
| 42 | A | S-1 (1.7) | SS-3 (2.1) | — |
| 43 | A | S-1 (1.7) | — | SA-3 (1.1) |
| 44 | A | S-1 (1.7) | SS-3 (2.1) | SA-3 (1.1) |
| 45 | A | S-4 (1.7) | — | — |
| 46 | A | S-4 (1.7) | SS-3 (2.1) | — |
| 47 | A | S-4 (1.7) | SS-3 (2.1) | SA-3 (1.1) |
| 48 | A | S-9 (1.7) | — | — |
| 49 | A | S-9 (1.7) | SS-3 (2.1) | — |
| 50 | A | S-9 (1.7) | SS-3 (2.1) | SA-3 (1.1) |
| 51 | A | S-11 (1.7) | — | — |
| 52 | A | S-11 (1.7) | SS-9 (2.1) | — |
| 53 | A | S-11 (1.7) | SS-9 (2.1) | SA-6 (1.1) |
| 54 | A | S-12 (1.7) | — | — |
| 56 | A | S-12 (1.7) | SS-3 (2.1) | SA-3 (1.1) |
| 57 | A | S-12 (1.7) | SS-5 (2.1) | SA-4 (1.1) |
| 58 | A | S-16 (1.7) | — | — |
| 59 | A | S-16 (1.7) | SS-1 (2.1) | — |
| 60 | A | S-16 (1.7) | SS-1 (2.1) | SA-7 (1.1) |
| 61 | A | S-21 (1.7) | — | — |
| 62 | B | S-21 (1.7) | SS-5 (2.1) | — |
| 63 | B | S-21 (1.7) | SS-5 (2.1) | SA-11 (1.1) |
| 64 | B | (III) (1.7) | SS-3 (2.1) | — |
| 65 | B | (III) (1.7) | SS-3 (2.1) | SA-3 (1.1) |
| 66 | B | S-12 (1.7) | (III) (2.1) | — |
| 67 | B | S-12 (1.7) | SS-3 (2.1) | (IV) (1.1) |

TABLE 4

| Sample No. | Photographic performance Aging substitute thermostatic treatment Untreated Sensitivity | Fog | γ | Rank of residual color | Treated Sensitivity | Fog | γ | Remarks |
|---|---|---|---|---|---|---|---|---|
| 40 | 100 | 0.04 | 14 | 5.0 | 99 | 0.05 | 14 | X |
| 41 | 122 | 0.04 | 14 | 5.0 | 123 | 0.04 | 14 | Y |
| 42 | 126 | 0.04 | 14 | 5.0 | 127 | 0.04 | 14 | " |
| 43 | 128 | 0.05 | 14 | 4.0 | 129 | 0.06 | 14 | X |
| 44 | 162 | 0.05 | 14 | 4.0 | 163 | 0.06 | 14 | Y |
| 45 | 114 | 0.04 | 13 | 5.0 | 115 | 0.05 | 13 | X |
| 46 | 144 | 0.04 | 14 | 5.0 | 143 | 0.06 | 14 | Y |
| 47 | 177 | 0.05 | 14 | 4.0 | 178 | 0.05 | 14 | " |
| 48 | 107 | 0.04 | 14 | 5.0 | 106 | 0.05 | 14 | X |
| 49 | 132 | 0.04 | 14 | 5.0 | 133 | 0.05 | 14 | Y |
| 50 | 171 | 0.05 | 14 | 4.0 | 170 | 0.05 | 14 | " |
| 51 | 105 | 0.04 | 14 | 4.5 | 107 | 0.04 | 14 | X |
| 52 | 130 | 0.04 | 14 | 4.5 | 129 | 0.04 | 14 | Y |
| 53 | 162 | 0.04 | 14 | 3.5 | 163 | 0.04 | 14 | " |
| 54 | 110 | 0.04 | 14 | 5.0 | 109 | 0.04 | 14 | X |
| 55 | 139 | 0.04 | 14 | 5.0 | 137 | 0.04 | 14 | Y |
| 56 | 177 | 0.04 | 14 | 4.0 | 178 | 0.05 | 14 | " |
| 57 | 168 | 0.04 | 14 | 4.0 | 167 | 0.05 | 14 | Y |
| 58 | 109 | 0.04 | 14 | 5.0 | 108 | 0.04 | 14 | X |
| 59 | 136 | 0.04 | 14 | 5.0 | 138 | 0.04 | 14 | Y |
| 60 | 167 | 0.04 | 14 | 4.0 | 165 | 0.04 | 14 | " |
| 61 | 102 | 0.04 | 14 | 4.0 | 103 | 0.04 | 14 | X |
| 62 | 128 | 0.04 | 14 | 4.0 | 129 | 0.04 | 14 | Y |
| 63 | 162 | 0.04 | 14 | 3.5 | 161 | 0.04 | 14 | " |
| 64 | 104 | 0.05 | 13 | 4.0 | 99 | 0.05 | 12 | X |
| 65 | 113 | 0.04 | 14 | 3.5 | 109 | 0.05 | 13 | " |
| 66 | 114 | 0.04 | 14 | 5.0 | 115 | 0.04 | 14 | " |
| 67 | 134 | 0.05 | 14 | 4.0 | 135 | 0.06 | 14 | Y |

X: Comparative Example, Y: Present Invention

As is clear from the tables, compared with comparative samples, the combination of the spectral sensitizing dyes according to the present invention can bring about light-sensitive materials having high photographic performances, i.e, having a high sensitivity, causing less fog and sensitivity variations and having a contrast, in those tested immediately after preparation and those after aging tests (substitute thermostatic tests). The samples according to the present invention also cause less residual color stain compared with the comparative samples As described above, the present invention can provide a light-sensitive silver halide photographic material having a higher spectral sensitivity in the red-light wavelength region and also improved in residual color stain proofness.

What is claimed is:

1. A silver halide photographic light-sensitive material comprising a support and thereon at least one light-sensitive silver halide emulsion layer, wherein said silver halide emulsion layer contains a compound represented by Formula S-I and a compound represented by Formulas S-II or S-III:

Formula S-I;

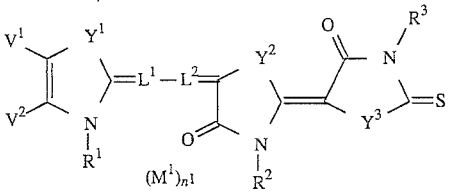

Formula S-II;

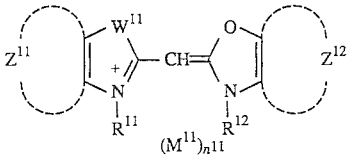

Formula S-III;

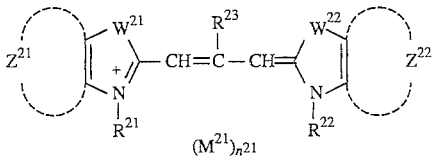

wherein, $Y^1$, $Y^2$ and $Y^3$ each represent a —N(R)— group, an oxygen atom, a sulfur atom or a selenium atom; $W^{11}$ represents an oxygen atom, a sulfur atom or a selenium atom; $W^{21}$ and $W^{22}$ each represent a sulfur atom or a selenium atom; $R^1$ represents an aliphatic group having 10 or less carbon atoms and having a water-solubilizing group; R, $R^2$ and $R^3$ each represent an aliphatic group, an aryl group or a heterocyclic group, provided that at least two of R, $R^2$ and $R^3$ have a water-solubilizing group as a substituent; $R^{11}$ and $R^{12}$ each represent an aliphatic group having 10 or less carbon atoms, provided that at least one of $R^{11}$ and $R^{12}$ has a water-solubilizing group as a substituent; $R^{21}$ and $R^{22}$ each represent an aliphatic group having 10 or less carbon atoms, $R^{23}$ represents a hydrogen atom, an aliphatic group, an aryl group or a heterocyclic group; $V^1$ and $V^2$ each represent a hydrogen atom, an alkyl group, an alkoxyl group or an aryl group, provided that $V^1$ and $V^2$ may combine to form a condensed ring together with an azole ring; $L^1$ and $L^2$ each independently represent a substituted or unsubstituted methine carbon; $Z^{11}$ and $Z^{12}$ each represent a nonmetal atomic group necessary to form a condensed cyclic hydrocarbon ring, $Z^{21}$ and $Z^{22}$ each represent a non-metal atomic group necessary to form a condensed benzene ring or a condensed naphthalene ring, provided that at least one group of $Z^{21}$ and $Z^{22}$ forms a condensed naphthalene group; $M^1$, $M^{11}$ and $M^{21}$ each represent an ion necessary for neutralizing the total charge of a molecule; $n^1$, $n^{11}$ and $n^{21}$ each represent a number necessary for cancelling the charge of the molecule.

2. The silver halide photographic light-sensitive material of claim 1, wherein $Z^{11}$ and $Z^{12}$ each represent a non-metal atomic group necessary to form a condensed benzene ring or a condensed naphthalene ring.

3. The silver halide photographic light-sensitive material of claim 1, wherein the water solubilizing group is selected from the group consisting of a sulfo group, a carboxyl group, a phosphono group, a sulfate group and a sulfino group.

4. The silver halide photographic light-sensitive material of claim 1, wherein, in the Formula S-I, $R^1$ represents an alkyl group having a sulfo group and at least two of R, $R^2$ and $R^3$ are a carboxymethyl group.

5. The silver halide photographic light-sensitive material of claim 1, wherein, in the Formula S-II, $W^{11}$ represents an oxygen atom and $Z^{11}$ and $Z^{12}$ each represent a condensed benzene ring, and $R^{11}$ and $R^{12}$ represent an alkyl group having a sulfo group at the same time.

6. The silver halide photographic light-sensitive material of claim 1, wherein the addition amount of the compound represented by Formula S-I and the compound represented by Formulas S-II and Formula S-III is within the range of $1\times10^{-6}$ to $5\times10^{-3}$ mols per mol of silver halide.

7. The silver halide photographic light-sensitive material of claim 1, wherein the addition amount of the compound represented by Formula S-I and the compound represented by Formulas S-II and Formula S-III is within the range of $2\times10^{-6}$ to $2\times10^{-3}$ mols per mol of silver halide.

8. A silver halide photographic light-sensitive material comprising a support and thereon at least one light-sensitive silver halide emulsion layer, wherein said silver halide emulsion layer contains a compound represented by Formula S-I and a compound represented by Formulas S-II or S-III:

Formula S-I;

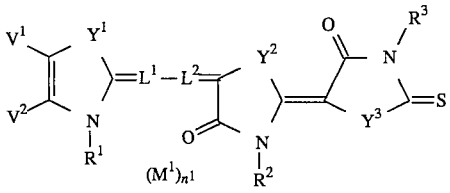

-continued

Formula S-II;

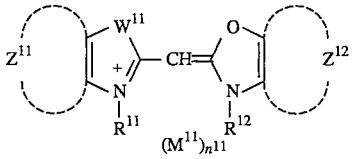

Formula S-III;

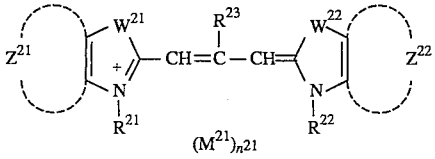

wherein, $Y^1$, $Y^2$ and $Y^3$ each represent a —N(R)— group, an oxygen atom, a sulfur atom or a selenium atom; $W^{11}$ represents an oxygen atom, a sulfur atom or a selenium atom; $W^{21}$ and $W^{22}$ each represent a sulfur atom or a selenium atom; $R^1$ represents an aliphatic group having 10 or less carbon atoms and having a water-solubilizing group; R, $R^2$ and $R^3$ each represent an aliphatic group, an aryl group or a heterocyclic group, provided that at least two of R, $R^2$ and $R^3$ have a water-solubilizing group as a substituent; $R^{11}$ and $R^{12}$ each represent an aliphatic group having 10 or less carbon atoms, provided that at least one of $R^{11}$ and $R^{12}$ has a water-solubilizing group as a substituent; $R^{21}$ and $R^{22}$ each represent an aliphatic group having 10 or less carbon atoms, $R^{23}$ represents a hydrogen atom, an aliphatic group, an aryl group or a heterocyclic group; $V^1$ and $V^2$ each represent a hydrogen atom, an alkyl group, an alkoxyl group or an aryl group, provided that $V^1$ and $V^2$ may combine to form a condensed ring together with an azole ring; $L^1$ and $L^2$ each independently represent a substituted or unsubstituted methine carbon; $Z^{11}$ and $Z^{12}$ each represent a nonmetal atomic group necessary to form a condensed cyclic hydrocarbon ring, a condensed benzene ring or a condensed naphthalene ring, $Z^{21}$ and $Z^{22}$ each represent a non-metal atomic group necessary to form a condensed benzene ring or a condensed naphthalene ring, provided that at least one group of $Z^{21}$ and $Z^{22}$ forms a condensed naphthalene group; $M^1$, $M^{11}$ and $M^{21}$ each represent an ion necessary for neutralizing the total charge of a molecule; $n^1$, $n^{11}$ and $n^{21}$ each represent a number necessary for cancelling the charge of the molecule, and the water solubilizing group is selected from the group consisting of a sulfo group, a carboxyl group, a phosphono group, a sulfate group and a sulfino group.

* * * * *